US005992269A

United States Patent [19]

Puig et al.

[11] Patent Number: 5,992,269

[45] Date of Patent: Nov. 30, 1999

[54] CORKSCREW

[76] Inventors: Ramon Brucart Puig; Marta Bonich Linares, both of Gustavo Becquer, 105, 08206-Sabadell (Barcelona), Spain

[21] Appl. No.: 08/975,407

[22] Filed: Nov. 20, 1997

[30] Foreign Application Priority Data

Nov. 21, 1996 [ES] Spain ..... 9602975 U

[51] Int. Cl.[6] ..... B67B 7/00

[52] U.S. Cl. ..... 81/3.35; 81/3.47; 81/3.48

[58] Field of Search ..... 81/3.09, 3.35, 81/3.37, 3.47, 3.48

[56] References Cited

U.S. PATENT DOCUMENTS 786,492 4/1905 Garimaldi ..... 81/3.37 X 1,273,026 7/1918 Brown ..... 81/3.37 X

FOREIGN PATENT DOCUMENTS 571272 2/1933 Germany ..... 81/3.37

*Primary Examiner*—James G. Smith

*Attorney, Agent, or Firm*—Michael J. Striker

[57] ABSTRACT

A corkscrew has a body having a central part and an end part, a helix provided at the central part of the body, an end arm provided on the end part of the body, the end arm having an end provided with a first fulcrum and an internal medium part provided with a mechanism for forming an intermediate auxiliary fulcrum under the action of a manual drive of a user to facilitate a drawing action on a cork in which the helix has been introduced.

8 Claims, 3 Drawing Sheets

FIG.1
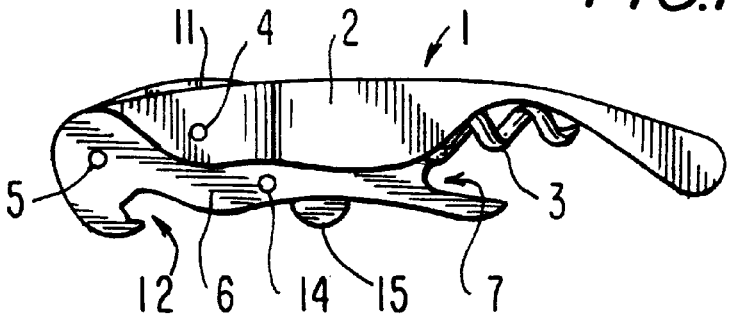
FIG.2
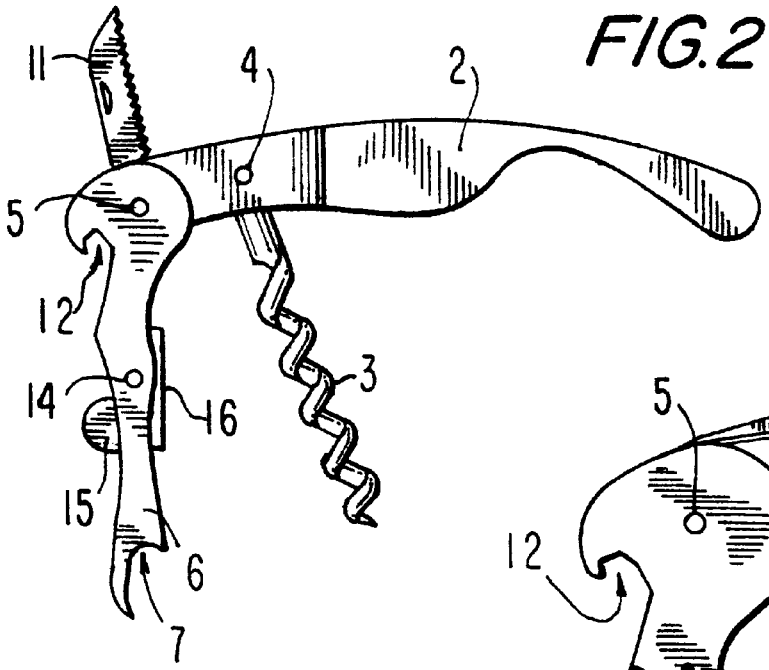
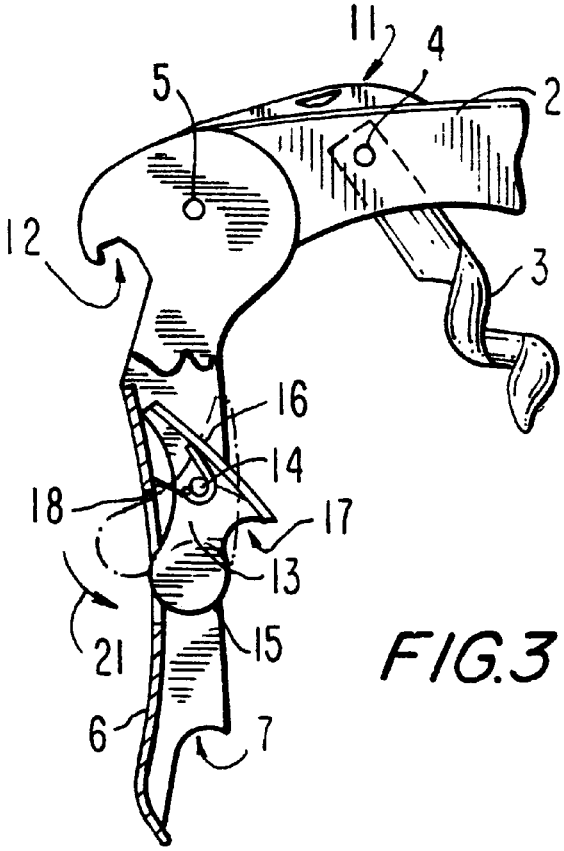
FIG.3

CORKSCREW

BACKGROUND OF THE INVENTION

The present invention relates to a corkscrew and more particularly to a manual type lever driven corkscrew.

Corkscrews of the above mentioned general type are known in the art. The known corkscrews of this type operate by introducing a helix sharp point into a cork to be drawn so as to exert an action in a cork exit direction by a lever arm to which the helixes secured. This action is assisted by an end fulcrum on a bottle mouth edge. The corkscrew of this type represents actually a second-class lever with a fulcrum at one end and a load at a central area.

The corkscrew of the above mentioned type has however the disadvantage in that, when drawing something by raising the lever in the cork exit direction, in many cases the fulcrum arm length is not sufficient to allow a full withdrawal. Therefore, the operation must be repeated by introducing the helix deeper within the partly drawn cork, with the final withdrawal by the fulcrum.

SUMMARY OF THE INVENTION

Accordingly, it is an object of the present invention to provide a corkscrew of the above mentioned type, which avoids the disadvantages of the prior art.

In keeping with these objects and with others which will become apparent hereinafter, one feature of present invention resides, briefly stated, in a corkscrew, in which in accordance with the present invention a mechanism is provided at an internal medium part of the end arm and allows, under the action of the user's manual drive, to provide an auxiliary fulcrum so that the cork is more quickly drawn without a deeper introduction of the helix.

When the corkscrew is designed in accordance with the present invention, the cork can be fully drawn in a single action, without a new deeper introduction of the helix.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side external view of a corkscrew in accordance with the present invention, in a closed position when it is not used;

FIG. 2 is a view showing the inventive corkscrew in an open position ready to be used for drawing a cork;

FIG. 3 is a view showing-an auxiliary fulcrum mechanism of the inventive corkscrew on an enlarged scale;

DESCRIPTION OF PREFERRED EMBODIMENTS

Figure 4:
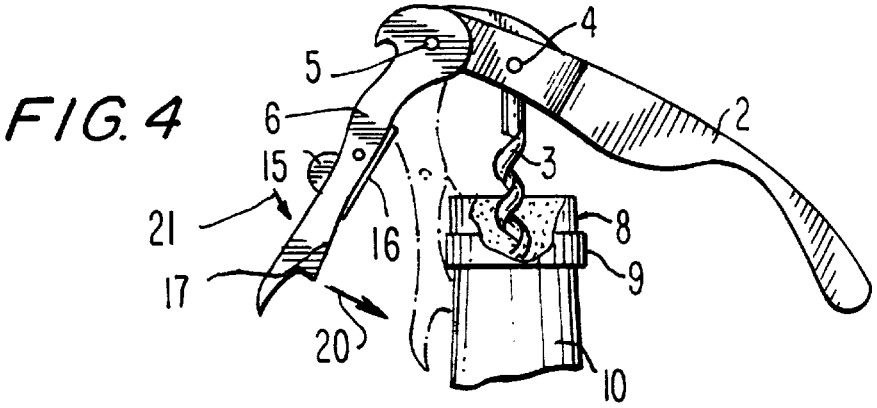
FIG. 4 is a view showing a first part of a corkscrew operation with a helix introduced within a cork closing a hole of a bottom mouth, a fulcrum arm already extended in a dotted line, and an auxiliary fulcrum located close to the bottom mouth.

A corkscrew in accordance with the present invention is identified as a whole with reference numeral 1. It has a body 2 which supports a sharp point 3 in its central area. The sharp point 3 is formed as a helix foldable about a locking shaft 4.

An arm 6 is foldably mounted on a locking shaft 5 at an end of the body 2 and has a step-recess shaped end part 7. It constitutes a fulcrum against a bottom 10 having a mouth 9 with a rim 8.

The arm 6 has an external face which is curved and more particularly convex. The curvature of the external face of the arm 6 substantially corresponds to an external curvature of the body 2 but in an opposite direction. In the closed position of the corkscrew it provides favorable ergonomic characteristics which greatly facilitate its use by a user, since the corkscrew is easily adapted to a hand hollow.

An auxiliary knife 11 is provided on the top of the body 2 of the corkscrew. More particularly, it is also foldable on the locking shaft 5. The auxiliary knife 11 is used for scrapping an encapsulation of the bottle mouth.

The arm 6 of the fulcrum has an auxiliary external recess 12. The recess 12 is utilized for opening crown plug bottles.

A mechanism for voluntarily locating an auxiliary fulcrum by a user is located on the fulcrum arm 6. The mechanism includes a beam 13 locked by a shaft 14 which keeps it within an internal hollow part of the arm 6. The beam 13 is rotatable about the shaft 14. It has an external part with a round projection 15 which is formed as a pushbutton and an external part with a flange 16. The flange 16 has a lower beak-shaped end 17 forming an auxiliary fulcrum.

The mechanism finally includes an expanding spring 18 having U-shaped ends supported on the internal face of the arm 6 and an internal part of the flat face 16 of the beam 13. The spring 18 is wound about the locking shaft 14 of the beam 13.

The above mentioned mechanism is arranged so that the beam 13 always remains in the position shown in FIGS. 1, 2, 7, 8. In this position the rounded projection 15 emerges outside the arm 6 and the auxiliary fulcrum 17 remains concealed.

When as shown in FIG. 3 the user exerts an action on the projection 15 in a direction of the arrow, the expanding action of the spring 18 is opposed and the beam 13 moves about the shaft 14 so that the lower end 17 of the flat face 16 of the beam emerges at the internal side of the arm 6 to form the required auxiliary fulcrum. This action is used by the user to carry out a first step of withdrawal of the cork 19.

Figure 5:
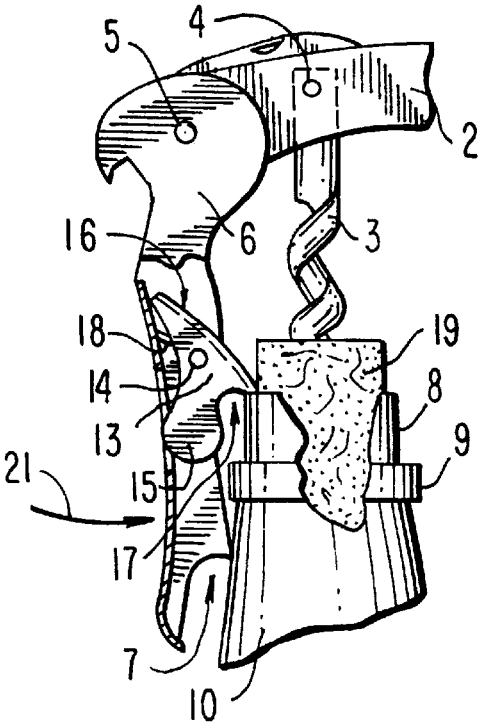
FIG. 5 is a view showing a fulcrum arm positioning, a use of auxiliary fulcrum supported on the mouth rim, and a cork being somewhat drawn.
Figure 6:
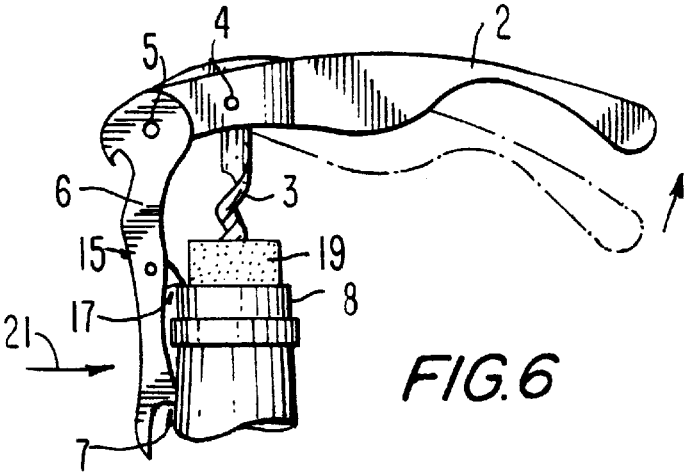
FIG. 6 is a view showing a corkscrew drawing action during a first step when the support on the auxiliary fulcrum occurs and with the cork somewhat drawn.
Figure 7:
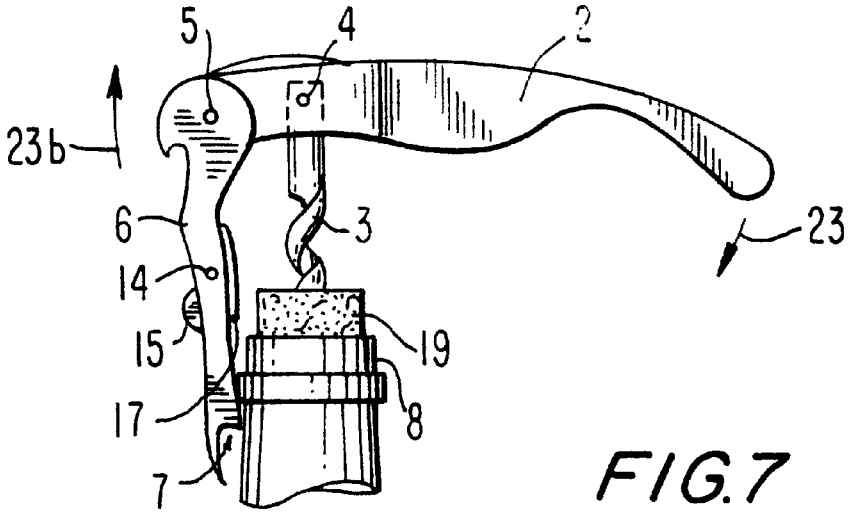
FIG. 7 is a view showing an action when a part of the cork being drawn, auxiliary fulcrum is no longer used, and it is preceded to locate the end fulcrum on the bottle mouth rim.
Figure 8:
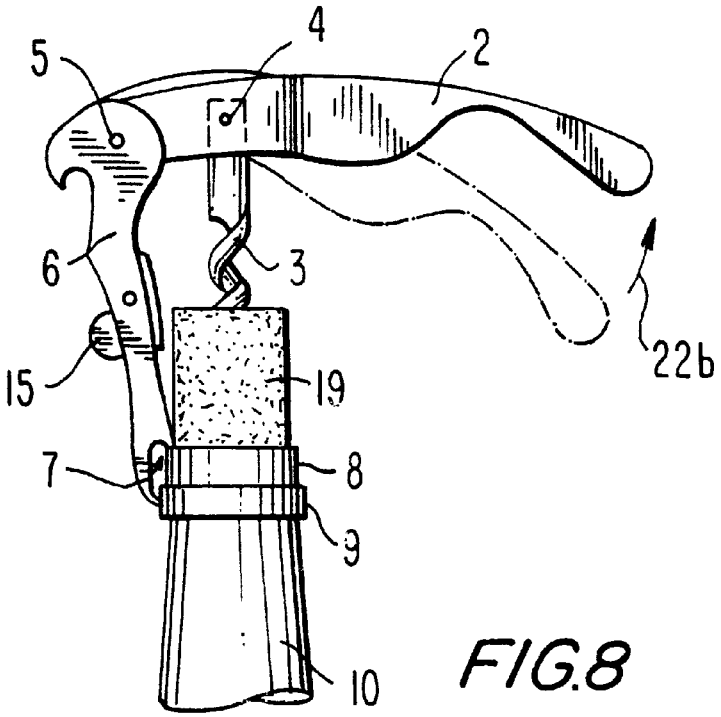
FIG. 8 is a view showing the corkscrew with the end fulcrum located at the action position against the bottle mouth rim.

When the helix 3 is introduced within the cork 19 fully concealed within the mouth 9 of the bottle 10 as shown in FIG. 4, the arm 6 is moved close to the mouth 9 as shown by the arrow 20 under the action on the projection 15 in direction of the arrow 21 to provide the auxiliary fulcrum 17. It is linked on the rim 8 of the bottle 10 and facilitates an upward first action of the body 2 in a direction of the arrow 22 as shown in FIGS. 5 and 6. A lever action about the shaft 5 partly draws the cork 19. When this first action has been performed, and as shown in FIG. 7, the projection 15 is no longer driven with the auxiliary fulcrum 17 concealed in the arm 6, the body 2 is tilted on the shaft 4 and is driven in a direction of the arrow 23. Therefore the arm 6 is lifted in a direction of the arrow 23*b* until the supporting recess 7 remains on the rib 8, and the cork 19 can be now withdrawn by lifting of the body 2 of the corkscrew in a direction of the arrow 22*b* as shown in FIG. 8.

The lifting action of the arm 6 until the recess 7 is arranged on the rib 5 is facilitated by the bending of the internal face of the arm 6. As can be seen from the drawings, the arm 6 is narrower at the height of the rim 16 than at the lower part where there is the fulcrum 7. This width difference delimits a slightly curved area which facilitates sliding of the internal face of the arm 6 on the rib 8 without meeting any hindrance, which otherwise could hinder the upward movement of the arm 6 in the direction of the arrow 23*b*.

It will be understood that each of the elements described above, or two or more together, may also find a useful application in other types of constructions differing from the types described above.

While the invention has been illustrated and described as embodied in corkscrew, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A corkscrew, comprising a body having a central part and an end part; a helix provided at said central part of said body; an end arm provided on said end part of said body, said end arm having an end provided with a first fulcrum and an internal medium part provided with a mechanism for forming an intermediate auxiliary fulcrum under the action of a manual drive of a user to facilitate a drawing action on a cork in which said helix has been introduced, said mechanism including a moving beam which is rotatable relative to said arm and provided with a flange concealable within said arm when not used and exiting said arm for use, said flange having an end forming said auxiliary fulcrum.

2. A corkscrew as defined in claim 1, wherein said flange is formed as a flat flange.

3. A corkscrew as defined in claim 1; and further comprising a shaft provided on an internal part of said arm and arranged so that said moving beam rotates about said shaft.

4. A corkscrew as defined in claim 1; and further comprising a projection provided on said moving beam and formed so that when a user acts on said projection it moves said flange from a concealed position to an exited position.

5. A corkscrew as defined in claim 4; and further comprising a spring urging said flange to a concealed position, said projection acting on said flange to move it from said concealed position to said exited position against a force of said spring.

6. A corkscrew as defined in claim 4, wherein said projection is formed as a rounded projection.

7. A corkscrew as defined in claim 5, wherein said moving beam has a shaft about which said flange rotates, said spring being wound about said shaft and having ends supported against an internal wall of said arm and an internal wall of said flange.

8. a corckscrew as defined in claim 1, wherein said arm has a convexly curved external part.

* * * * *